United States Patent [19]

Sato

[11] Patent Number: 4,539,125

[45] Date of Patent: Sep. 3, 1985

[54] WATER-BASED METAL-WORKING FLUID

[75] Inventor: Mikio Sato, Ichihara, Japan

[73] Assignee: Idemitsu Kosan Company, Japan

[21] Appl. No.: 553,067

[22] Filed: Nov. 18, 1983

[30] Foreign Application Priority Data

| | | | |
|---|---|---|---|
| Nov. 30, 1982 | [JP] | Japan | 57-208636 |
| Dec. 3, 1982 | [JP] | Japan | 57-212390 |
| Feb. 7, 1983 | [JP] | Japan | 58-17426 |

[51] Int. Cl.[3] ..... C10M 1/48; C10M 3/42; C10M 5/24; C10M 7/46

[52] U.S. Cl. ..... 252/32.7 E; 252/49.3; 252/49.5

[58] Field of Search ..... 252/49.3, 49.5, 32.7 E

[56] References Cited

U.S. PATENT DOCUMENTS

| | | | |
|---|---|---|---|
| 3,255,108 | 6/1966 | Wiese | 252/49.5 |
| 3,354,180 | 11/1967 | Ekiss | 252/49.5 |
| 3,629,112 | 12/1971 | Gower | 252/49.5 |
| 3,748,275 | 7/1973 | Bernheim | 252/49.5 |

*Primary Examiner*—John F. Niebling
*Attorney, Agent, or Firm*—McGlew and Tuttle

[57] ABSTRACT

Water-based metal-working fluid which contains a compound represented by the general forumla (I)

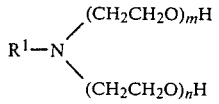

(I)

or further contains at least one compound selected from the group consisting of the compounds represented by the general formulae (II), (III) and (IV).

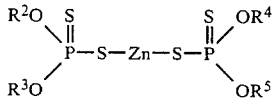

(II)

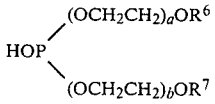

(III)

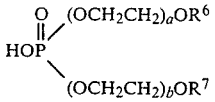

(IV)

Metal-working fluid of the present invention has a superior spoilage-inhibiting effect.

3 Claims, No Drawings

WATER-BASED METAL-WORKING FLUID

BACKGROUND OF THE INVENTION

Metal-working fluids have heretofore been inhibited from spoilage (degradation) by adding preservatives, particularly organic preservatives.

However, the spoilage-inhibiting effect of these organic preservatives varies depending on the type of microorganism; i.e., they show enough spoilage-inhibiting activity for specific microorganisms, but are insufficiently effective for the others. In using the organic preservatives, accordingly it is necessary to choose a suitable one taking into account the type of microorganism, and thus they lack general-purpose properties.

Some of the organic preservatives are decomposed by microorganisms. In the case of such organic preservatives, it is necessary for fresh preservatives to be added frequently since their spoilage-inhibiting effect is reduced in a short period of time. This gives rise to the problems that much labor and time are needed in the production of work pieces, and its production costs are increased. Furthermore most of the organic preservatives are sometimes harmful to human body, i.e., cause problems such as roughening of skin and rashes.

As another method of sterilization, it is known that metal-working fluid which has been used for a predetermined time is heated to relatively high temperatures to kill anaerobic bacteria in the metal-working fluid, and various additives lost by the heat treatment are supplemented simultaneously. Also in this method, however, much labor and time are needed, and furthermore no sufficient spoilage-inhibiting effect can be obtained.

A method has already been proposed in which metal-working fluid is contacted with metallic cobalt to inhibit the spoiling thereof (see Japanese Patent Application No. 22693/1982). This method, however, needs special equipment in the practice thereof.

SUMMARY OF THE INVENTION

The present invention is intended to overcome the problems as described above, and an object of the present invention is to provide water-based metal-working fluid which is sufficient to be blended without the use of special equipment, and which has a superior spoilage-inhibiting effect.

The present invention relates to:

(1) a water-based metal-working fluid which comprises containing a compound represented by the general formula (I):

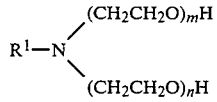

(I)

(wherein $R^1$ is an alkyl group, and $3 \leqq m+n \leqq 24$); and (2) a water-based metal-working fluid which comprises containing Components (A) and (B) as described below.

Component (A): a compound represented by the general formula (I) as defined above.

Component (B): at least one compound selected from the group consisting of the compounds represented by the general formula (II):

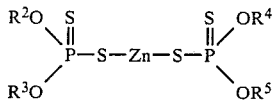

(II)

(wherein $R^2$, $R^3$, $R^4$ and $R^5$ may be the same or different, and are each an alkyl group or an aryl group), the phosphorus compounds represented by the general formula (III):

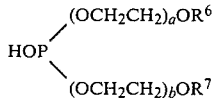

(III)

(wherein $R^6$ and $R^7$ are each an alkyl group, and $0 \leqq a+b \leqq 24$), and the phosphorus compounds represented by the general formula (IV):

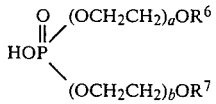

(IV)

(wherein all the symbols are as defined above).

DETAILED DESCRIPTION OF THE INVENTION

The compounds represented by the general formula (I) are polyoxyethylenealkylamines. In these polyoxyethylenealkylamines, the alkyl group preferably contains from 8 to 20 carbon atoms. These alkyl groups are straight or branched, including an octyl group, a decyl group, a dodecyl group, a tetradecyl group, a hexadecyl group, etc. In the general formula (I), the sum of m and n is from 3 to 24, and m and n are each preferably from 2 to 8 and more preferably from 2 to 5. Although m and n may be different, they are usually the same.

Suitable examples of the compounds represented by the general formula (I) are shown below.

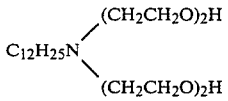

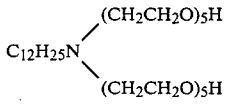

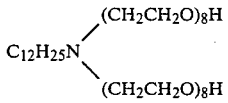

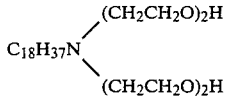

In one embodiment of the present invention, the water-based metal-working fluid contains a compound represented by the general formula (I).

In another embodiment of the present invention, the water-based metal-working fluid contains Components (A) and (B) as defined above.

The compounds represented by the general formula (II) are zinc dithiophosphates. The alkyl group represented by $R^2$ to $R^5$ preferably contains from 3 to 12 carbon atoms although it is not critical. The aryl group is also not critical, including a substituted aryl group. In this substituted aryl group, the substituent is preferably an alkyl group.

Typical examples of the compounds represented by the general formula (II) are compounds in which most of $R^2$, $R^3$, $R^4$ and $R^5$ are sec-hexyl groups, or sec-alkyl groups containing 5 or less carbon atoms, or $R^2$, $R^3$, $R^4$ and $R^5$ are isobutyl and n-amyl groups, or most of $R^2$, $R^3$, $R^4$ and $R^5$ are isoamyl groups, or alkylaryl groups.

The phosphorus compounds represented by the general formula (III) are polyoxyethylenephosphorous acid esters or dipolyoxyethylenephosphorous acid esters. The phosphorus compounds represented by the general formula (IV) are polyoxyethylenephosphoric acid esters or dipolyoxyethylenephosphoric acid esters. In the general formulae (III) and (IV), the alkyl group preferably contains from 4 to 16 carbon atoms although it is not critical, and the sum of a and b is from 0 to 24 and a and b are each preferably from 0 to 6. These phosphorus compounds are preferably water-soluble and oil-soluble.

Suitable examples of the phosphorus compounds represented by the general formulae (III) and (IV) are shown below.

$$(C_{12}H_{25}O)_2POH \quad (C_6H_{13}O)_2POH \quad (C_{12}H_{25}O)_2\overset{\overset{\displaystyle O}{\|}}{P}OH$$

$$[C_{12}H_{25}O(CH_2CH_2O)_2]_2POH$$

Two or more of each of the compounds represented by the general formulae (I) to (IV) can be selected appropriately and used in combination with each other.

The term "water-based metal-working fluid" as used herein refers to, for example, cutting oil, rolling oil, and heat-treating oil. The cutting oil is divided into an emulsion type oil composed mainly of mineral oil, an emulsifying agent, a corrosion inhibitor, a preservative, a stabilizer, and water, and a soluble type oil composed mainly of a large amount of surface active agent, and small amounts of mineral oil, corrosion inhibitor, and water. Moreover a chemical solution type fluid can be used. The chemical solution type fluid contains at least one compound selected from the group consisting of triethanolamine, monoethanolamine and N-methyl-diethanolamine instead of said mineral oil. The mineral oil such as paraffin-based oils and naphthene-based oils, the surface active agent and the amine such as triethanolamine, etc. are hereinafter referred to as "base oil".

The compounds represented by the general formulae (I) to (IV) are effective also as emulsifying agents to be used in the emulsion type cutting oil, and as surface active agents to be used in the soluble type cutting oil.

Some of rolling oils are of emulsion type. An example of heat-treating oils is composed of polyethylene glycol and water, etc.

In use the water-based metal-working fluid is diluted with water to a suitable extent, for example, to from 5 to 100 times and usually from 10 to 50 times, and then charged to a tank, for example, and circulated through the tank and working machines used.

Component (A) or (B) as described above is compounded at a suitable point before or after the dilution of the water-based metal-working fluid with water. As calculated based on the water-based metal-working fluid before dilution with water, in one embodiment of the present invention, the amount of the compound of the general formula (I), being compounded is from 1 to 10% by weight and preferably from 1 to 5% by weight, and in another embodiment of the present invention, the amount of the base oil being compounded is from 30 to 90% by weight and preferably from 40 to 80% by weight, the amount of Component (A), the compound of the general formula (I), being compounded is from 2 to 40% by weight and preferably from 3 to 30% by weight, and the amount of Component (B), at least one member of the compounds of the general formulae (II) to (IV), being compounded is from 2 to 30% by weight and preferably from 3 to 20% by weight.

If necessary, other commonly used additives can be added to the water-based metal-working fluid of the present invention. For example, nonionic surface active agents, such as sodium laurylsulfate, sorbitan monolaurate, polyoxyethylene alkyl ether, and polyoxyethylene nonylphenyl ether, and extreme pressure additives, e.g., chlorinated paraffins; sulfides, such as dibutylsulfide; tricresyl phosphate; and tributyl phosphate, can be added appropriately.

In the water-based metal-working fluid of the present invention, the spoilage-inhibiting effect is not limited to specific microorganisms but the growth of a wide variety of microorganisms is inhibited. Thus the water-based metal-working fluid of the present invention is free from the spoilage and has a long service life. The water-based metal-working fluid of the present invention does not cause enviromental pollutions such as generation of unpleasant odor and is of high safety to human body. Furthermore, since it is possible to compound the above component directly as a water-based metal-working crude fluid, no special equipment is needed. Hence the water-based metal-working fluid of the present invention is very useful in the field of metal-working.

The compounds of the general formula (I) to be used as Component (A) in the present invention exhibit marked bactericidal activity. Although the compounds of the general formula (I), when added to base oil, such as mineral oil, have been proved to be effective for the inhibition of spoilage, they exhibit bactericidal activity for a wide variety of microorganisms. Furthermore the compounds of the general formula (I) are of low toxicity, have reduced skin-irritating properties, and are very safe, and they show high solubility in both water and various organic solvents. Hence they will find a variety of uses. For example, they can be used effectively in the inhibition of rice blast disease, the treatment of dermatophytosis, and so forth, and further, as a spoilage-inhibiting agent for cooling water or paint.

When the compounds of the general formula (I) are used as preservatives, if necessary, other surface active agents; solvents such as water, methanol, ethanol, and dimethylformamide; organic or inorganic compounds having a metal-sealing ability (e.g., ethylenediaminetetraacetic acid and its salts, malonic acid and its salts, tripolyphosphoric acid, and pyrophosphoric acid); alkaline earth metal oxides or hydroxides; other preservatives; chelating agents; and so forth can be added. The compounds of the general formula (I) are used in such an amount that they constitute from 5 to 100%, preferably from 10 to 100% of the preservatives.

The present invention is described in greater detail with reference to the following Examples and Comparative Examples.

EXAMPLES 1 TO 15 AND COMPARATIVE EXAMPLES 1 TO 8

A series of emulsion type metal-working fluid were prepared by adding the predetermined amounts of compounds as shown in Table 1 to a fresh mineral oil (machine oil) as a base oil. Each metal-working fluid as prepared above was diluted with water to 30 times and, thereafter, 20 milliliters of the resulting solution was placed in a test tube. Then 200 milligrams of cast cut iron fines and one drop of the spoiled oil were dropped in the test tube, and static cultivation was performed at 30° C. for 10 days. The cast cut iron fines are mixed into the metal-working fluid during metal working.

After the cultivation, the viable cell count was determined, and the results are shown in Table 1. Anaerobic bacteria and sulfate-reducing bacteria, in particular, are responsible for the spoilage of metal-working oil.

In the determination of the viable cell count, the following culture media and cultivation methods were employed.

(1) Aerobic bacteria (determined by the agar plate method using bouillon)

Medium composition: 0.5% meat extract, 1.0% peptone, 0.5% sodium chloride, and 1.5% agar (pH: 7.0)

(2) Anaerobic bacteria (determined by the roll tube method using a VL basic culture medium)

Medium composition: 1.0% peptone, 0.5% yeast extract, 0.14% heart extract, 0.2% glucose, 0.045% potassium dihydrogenphosphate, 0.045% potassium monohydrogenphosphate, 0.09% ammonium sulfate, 0.09% sodium chloride, 0.009% magnesium sulfate (anhydrous salt), 0.09% calcium chloride (anhydrous salt), 1.5% agar, 0.03% cystine hydrochloride, and 0.4% sodium hydroxide (pH: 7.0)

(3) Sulfate-reducing bacteria (determined by the roll tube method)

A modified Starkey's medium (see American Type Culture Collection, 12th ed., page 331 (1976)) with 1.5% agar added thereto was used.

EXAMPLES 16 TO 20 AND COMPARATIVE EXAMPLES 9 TO 11

A series of soluble type metal-working fluid were prepared by compounding the predetermined amounts of compounds and additives as shown in Table 1. Thereafter, the same procedure as in Examples 1 to 15 was repeated, and after cultivation, the viable cell count was determined. The results are shown in Table 1.

TABLE 1

| | Example | | | | | | Comparative Example | | | |
|---|---|---|---|---|---|---|---|---|---|---|
| | 1 | 2 | 3 | 4 | 5 | 6 | 1 | 2 | 3 | 4 |
| Composition (% by weight) | | | | | | | | | | |
| Base Oil | 55 | 55 | 55 | 55 | 55 | 55 | 55.5 | 55 | 55 | 55 |
| Compound A*1 | | | | | | | 15 | | | |
| (Compounds of General Formula (I)) | | | | | | | | | | |
| Compound B*2 | 15 | | | | 7.5 | 7.5 | | | | |
| Compound C*3 | | 15 | | | | | | | | |
| Compound D*4 | | | 15 | | | | | | | |
| Compound E*5 | | | | 15 | | | | | | |
| Compound F*6 | | | | | | | | 15 | | |
| (Compounds of General Formula (II), (III), or (IV)) | | | | | | | | | | |
| Zn-DTP*7 | 10 | 10 | 10 | 10 | 10 | 5 | 10 | 10 | | 10 |
| Compound a*8 | | | | | | | | | | |
| Compound b*9 | | | | | | | | | | |
| Compound c*10 | | | | | | | | | | |
| Compound d*11 | | | | | | | | | | |
| Polyoxyethylene nonylphenyl ether | | | | | 7.5 | 7.5 | 7.5 | | 15 | 15 |
| Chlorinated paraffin | | | | | | 5 | | | 10 | |
| Sodium laurylsulfate | 3 | 3 | 3 | 3 | 3 | 3 | | 3 | 3 | 3 |
| Triethanolamine | 5 | 5 | 5 | 5 | 5 | 5 | | 5 | 5 | 5 |
| Benzotriazole | | | | | | | | | | |
| Lard | 10 | 10 | 10 | 10 | 10 | 10 | 10 | 10 | 10 | 10 |
| Tap water | 2 | 2 | 2 | 2 | 2 | 2 | 2 | 2 | 2 | 2 |
| Viable Cell Count (cells per milliliter)*12 | | | | | | | | | | |
| Aerobic bacteria | 0 | $5.7 \times 10^4$ | 0 | $6.0 \times 10^4$ | 0 | 0 | $2.2 \times 10^7$ | $1.0 \times 10^7$ | $1.5 \times 10^7$ | $1.3 \times 10^7$ |
| Anaerobic bacteria | 0 | 0 | 0 | 0 | 0 | 0 | $1.3 \times 10^5$ | $2.3 \times 10^4$ | $4.7 \times 10^6$ | $1.0 \times 10^3$ |
| Sulfate-reducing bacteria | 0 | 0 | 0 | 0 | 0 | 0 | 0 | 0 | $4.0 \times 10^6$ | 0 |

| | Example | | | | | | | | |
|---|---|---|---|---|---|---|---|---|---|
| | 7 | 8 | 9 | 10 | 11 | 12 | 13 | 14 | 15 |
| Composition (% by weight) | | | | | | | | | |
| Base Oil | 55 | 55 | 55 | 55 | 55 | 55 | 55 | 55 | 55 |
| Compound A*1 | | | | | | | | | |
| (Compounds of General Formula (I)) | | | | | | | | | |
| Compound B*2 | 15 | | | | 7.5 | 7.5 | 15 | 15 | 15 |
| Compound C*3 | | 15 | | | | | | | |
| Compound D*4 | | | 15 | | | | | | |
| Compound E*5 | | | | 15 | | | | | |
| Compound F*6 | | | | | | | | | |
| (Compounds of General Formula (II), (III), or (IV)) | | | | | | | | | |
| Zn-DTP*7 | | | | | | | | | |
| Compound a*8 | 10 | 10 | 10 | 10 | 10 | 5 | | | |
| Compound b*9 | | | | | | | 10 | | |
| Compound c*10 | | | | | | | | 10 | |

TABLE 1-continued

| | | | | | | | | | |
|---|---|---|---|---|---|---|---|---|---|
| Compound d*11 | | | | | | | | | 10 |
| Polyoxyethylene nonylphenyl ether | | | | | 7.5 | 7.5 | | | |
| Chlorinated paraffin | | | | | | 5 | | | |
| Sodium laurylsulfate | 3 | 3 | 3 | 3 | 3 | 3 | 3 | 3 | 3 |
| Triethanolamine | 5 | 5 | 5 | 5 | 5 | 5 | 5 | 5 | 5 |
| Benzotriazole | | | | | | | | | |
| Lard | 10 | 10 | 10 | 10 | 10 | 10 | 10 | 10 | 10 |
| Tap water | 2 | 2 | 2 | 2 | 2 | 2 | 2 | 2 | 2 |
| Viable Cell Count (cells per milliliter)*12 | | | | | | | | | |
| Aerobic bacteria | $1.5 \times 10^7$ | $4.4 \times 10^7$ | $1.3 \times 10^7$ | $6.0 \times 10^7$ | $1.0 \times 10^7$ | $3.1 \times 10^7$ | $4.5 \times 10^7$ | $1.0 \times 10^7$ | $3.3 \times 10^7$ |
| Anaerobic bacteria | $1.1 \times 10^4$ | $2.3 \times 10^5$ | $1.4 \times 10^4$ | $1.0 \times 10^5$ | $4.1 \times 10^4$ | $1.1 \times 10^4$ | $6.0 \times 10^4$ | $2.2 \times 10^4$ | $2.3 \times 10^5$ |
| Sulfate-reducing bacteria | 0 | 0 | 0 | 0 | 0 | 0 | 0 | 0 | 0 |

| | Example | | | | | Comparative Example | | |
|---|---|---|---|---|---|---|---|---|
| | 16 | 17 | 18 | 19 | 20 | 5 | 6 | 7 |
| Composition (% by weight) | | | | | | | | |
| Base Oil | | | | | | 55.5 | 55 | 55 |
| Compound A*1 | 10 | 10 | | | | 15 | | |
| (Compounds of General Formula (I)) | | | | | | | | |
| Compound B*2 | 10 | | 10 | 10 | 10 | | | |
| Compound C*3 | | | | | | | | |
| Compound D*4 | | 10 | | | | | | |
| Compound E*5 | | | | | | | | |
| Compound F*6 | | | | | | | 15 | |
| (Compounds of General Formula (II), (III), or (IV)) | | | | | | | | |
| Zn-DTP*7 | | | | | | | | |
| Compound a*8 | 5 | 5 | | | | 10 | 10 | |
| Compound b*9 | | | 5 | | | | | |
| Compound c*10 | | | | 5 | | | | |
| Compound d*11 | | | | | 5 | | | |
| Polyoxyethylene nonylphenyl ether | | | 10 | 10 | 10 | 7.5 | | 15 |
| Chlorinated paraffin | | | | | | | | 10 |
| Sodium laurylsulfate | 5 | 5 | 5 | 5 | 5 | | 3 | 3 |
| Triethanolamine | 30 | 30 | 30 | 30 | 30 | | 5 | 5 |
| Benzotriazole | 2 | 2 | 2 | 2 | 2 | | | |
| Lard | | | | | | 10 | 10 | 10 |
| Tap water | 38 | 38 | 38 | 38 | 38 | 2 | 2 | 2 |
| Viable Cell Count (cells per milliliter)*12 | | | | | | | | |
| Aerobic bacteria | 0 | $1.0 \times 10^6$ | $2.3 \times 10^6$ | 0 | $3.0 \times 10^6$ | $6.2 \times 10^7$ | $3.0 \times 10^7$ | $2.2 \times 10^7$ |
| Anaerobic bacteria | 0 | 0 | 0 | 0 | 0 | $4.0 \times 10^6$ | $2.5 \times 10^6$ | $4.0 \times 10^6$ |
| Sulfate-reducing bacteria | 0 | 0 | 0 | 0 | 0 | $1.8 \times 10^5$ | $2.3 \times 10^5$ | $6.6 \times 10^6$ |

| | Comparative Example | | | |
|---|---|---|---|---|
| | 8 | 9 | 10 | 11 |
| Composition (% by weight) | | | | |
| Base Oil | 55 | | | |
| Compound A*1 | | | 10 | 10 |
| (Compounds of General Formula (I)) | | | | |
| Compound B*2 | | | 10 | |
| Compound C*3 | | | | |
| Compound D*4 | | | | 10 |
| Compound E*5 | | | | |
| Compound F*6 | | | | |
| (Compounds of General Formula (II), (III), or (IV)) | | | | |
| Zn-DTP*7 | | | | |
| Compound a*8 | 10 | 10 | | |
| Compound b*9 | | | | |
| Compound c*10 | | | | |
| Compound d*11 | | | | |
| Polyoxyethylene nonylphenyl ether | 15 | 15 | | |
| Chlorinated paraffin | | | 5 | 5 |
| Sodium laurylsulfate | 3 | 5 | 5 | 5 |
| Triethanolamine | 5 | 30 | 30 | 30 |
| Benzotriazole | | 2 | 2 | 2 |
| Lard | 10 | | | |
| Tap water | 2 | 38 | 38 | 38 |
| Viable Cell Count (cells per milliliter*12 | | | | |
| Aerobic bacteria | $3.1 \times 10^7$ | $3.0 \times 10^7$ | $3.1 \times 10^7$ | $2.7 \times 10^7$ |
| Anaerobic bacteria | $3.7 \times 10^5$ | $2.2 \times 10^5$ | $1.0 \times 10^5$ | $2.8 \times 10^5$ |

TABLE 1-continued

| | | | | |
|---|---|---|---|---|
| Sulfate-reducing bacteria | $4.3 \times 10^5$ | 0 | $3.3 \times 10^3$ | $8.5 \times 10^3$ |

Note:

*1Chemical formula; $CH_3N(CH_2CH_2OH)_2$

*2Chemical formula; $C_{12}H_{25}N(CH_2CH_2O)_2H)_2$

*3Chemical formula; $C_{18}H_{37}N(CH_2CH_2O)_2H)_2$

*4Chemical formula; $C_{12}H_{25}N(CH_2CH_2O)_5H)_2$

*5Chemical formula; $C_{12}H_{25}N(CH_2CH_2O)_8H)_2$

*6Chemical formula; $C_{18}H_{37}N(CH_2CH_2O)_{20}H)_2$

*7Zinc dithiophosphate in which most of $R^2$, $R^3$, $R^4$ and $R^5$ are sec-alkyl groups containing 6 carbon atoms (trade name: Lubrizol 677, produced by Nippon Lubrizol Co., Ltd.)

*8$(C_{12}H_{25}O)_2POH$

*9$(C_6H_{13}O)_2POH$

*10$(C_{12}H_{25}O)_2P(=O)OH$

*11$[C_{12}H_{25}O(CH_2CH_2O)_2]_2POH$

*12The viable cell count when the rotten oil was added was as follows:

Aerobic bacteria: $2.0 \times 10^5$ per milliliter

Anaerobic bacteria: $1.1 \times 10^4$ per milliliter

Sulfuric acid-reducing bacteria: $5.3 \times 10^2$ per milliliter

Using Compounds A, B, and D used in the foregoing Examples and Comparative Examples, and Compound G represented by the formula as described hereinafter, incubation was performed under the respective cultivation conditions, and the minimum growth-inhibiting concentration was determined by the agar plate method. The results are shown in Table 2.

Compound G:

$C_{18}H_{37}N(CH_2CH_2O)_{15}H)_2$

TABLE 2

| Strain | Cultivation Conditions*1 | Minimum Growth-Inhibiting Concentration (ppm) Compound B | Compound D | Compound A | Compound G |
|---|---|---|---|---|---|
| *Pseudomonas aeruginosa* | A | >5000 | >5000 | >5000 | >5000 |
| Pseudomonas sp. | A | 200 | 1000 | >5000 | >5000 |
| *Pseudomonas fluorescens* IFO 3903 | A | 50 | 200 | >5000 | — |
| *Escherichia coli* | A | 200 | 5000 | >5000 | >5000 |
| *Proteus morganii* | A | 200 | 5000 | >5000 | >5000 |
| Unfixed gram-negative rod | A | 50 | 50 | — | — |
| *Bacillus subtilis* IFO 3007 | A | 10 | 50 | >5000 | 1000 |
| *Sarcina lutea* IFO 3232 | A | 10 | 10 | — | — |
| *Fusarium solani* | B | 50 | 200 | >5000 | 5000 |
| Fusarium sp. | B | 50 | 50 | — | — |
| *Aspergillus niger* IAM 3001 | B | 200 | 200 | >5000 | >5000 |
| *Piricularia oryzae* | B | 200 | 200 | — | — |
| *Trichophyton mentagrophytes* IFO 5466 | C | 50 | 50 | — | — |
| *Trichophyton mentagraphytes* IFO 5809 | C | 50 | 200 | — | — |
| *Trichophyton rubrum* IFO 5467 | C | 10 | 50 | — | — |
| *Rhodotorula rubra* | B | 50 | 200 | >5000 | 5000 |
| *Saccharomyces cerevisiae* IFO 209 | B | 50 | 50 | — | 1000 |

Note: *1;

A, Bouillon medium 30° C., 48 hours.

B, Potato dextrose medium, 28° C., 96 hours.

C, Sabouraud medium, 28° C., 168 hours.

What is claimed is:

1. A method of inhibiting a water-based metal-working fluid from spoilage which comprises including in the water-based metal-working fluid the combination of:

(A) a mineral oil, (B) a spoilage inhibiting compound selected from the group consisting of the compounds represented by the formulae:

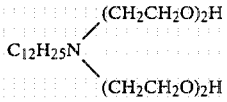

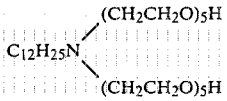

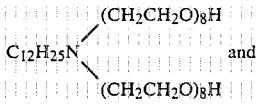

and

-continued

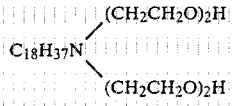

and (C) a phosphorous compound selected from the group consisting of the compounds represented by the formula:

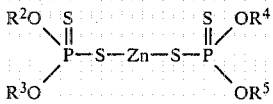

wherein $R^2$, $R^3$, $R^4$ and $R^5$ are sec.-alkyl groups containing 6 carbon atoms.

2. Method of claim 1 wherein said water-based metal-working fluid is diluted to the extent of from 5 to 100 times with water.

3. Method of claim 1 wherein said combination includes, by weight, from 30 to 90% of (A), from 2 to 40% of (B) and from 2 to 30% of (C).

* * * * *